United States Patent [19]

Fathauer

[11] 3,966,069

[45] June 29, 1976

[54] SPREADER FOR LIFTING CONTAINERS

[75] Inventor: Jack E. Fathauer, Roxboro, N.C.

[73] Assignee: RPC Corporation, Roxboro, N.C.

[22] Filed: Nov. 29, 1974

[21] Appl. No.: 528,168

[52] U.S. Cl. ..... 214/620; 294/67 DA; 294/81 SF

[51] Int. Cl.[2] ..... B66F 9/14

[58] Field of Search ..... 214/620, 621, 730, 731, 214/750; 294/67 R, 67 DA, 67 DB, 81 R, 81 SF

[56] References Cited

UNITED STATES PATENTS

| | | | |
|---|---|---|---|
| 3,552,557 | 1/1971 | Green | 214/621 |
| 3,589,540 | 6/1971 | Kinross | 214/621 |
| 3,709,392 | 1/1973 | Kinross | 214/620 |
| 3,863,970 | 2/1975 | Gottlieb et al. | 294/67 DA |

*Primary Examiner*—Robert J. Spar
*Assistant Examiner*—L. J. Paperner

[57] ABSTRACT

A spreader for lifting containers comprises a generally rectangular frame having container engaging devices adjacent the corners thereof and being mountable on the tines of a fork truck or the like for movement rotatably about a generally vertical axis, and horizontally in directions both parallel and perpendicular to the longitudinal axes of the tines. The frame includes base and upper frames, and at least one of such frames includes an elongated slot extending generally parallel to one of the horizontal directions of movement. A pin extending outwardly from the other of such frames is received in the slot for restraining the upper frame against complete displacement from the base frame, as well as for guiding certain movements of the upper frame relative to the base frame. The upper frame is rotated and moved horizontally in a direction generally perpendicular to the longitudinal axes of the tines by selectively operable common power means which comprises a pair of hydraulic cylinders connected between the base and upper frames.

13 Claims, 2 Drawing Figures

SPREADER FOR LIFTING CONTAINERS

BACKGROUND OF THE INVENTION

This application pertains to the art of spreaders for lifting containers and, more particularly, to such spreaders which are mountable upon the tines of a fork truck or the like.

It is common to removably mount spreaders on forks of lift trucks or the like for use in top lifting containers for transportation from one location to another, and for stacking or unstacking such containers. The spreader is quickly detachable from the fork tines so that the fork truck can be used for other conventional purposes.

When using a container lifting spreader with a fork truck or the like, it is often difficult for the vehicle operator to properly align the spreader frame with a container. It is also frequently difficult for the vehicle operator to properly align a container for stacking. This is because the vehicle has limited movement in certain directions, and such alignment is particularly difficult with a side loading-type of fork truck. In order to overcome these difficulties, many arrangements have been proposed for allowing shifting movement of the spreader frame itself relative to the fork tines in order that the spreader frame can be properly aligned with a container without requiring any movement of the vehicle. Prior patents disclosing arrangements of this type include Meister 3,176,866 and Levitt 3,387,730 who disclose arrangements wherein a special traversing mechanism is built into the vehicle between the fork tines and their mast in order to allow lateral movement of the forks relative to the mast and vehicle. However, there is no provision for power shifting the container lifting spreader frame rotatably or longitudinally of the fork tines in order to achieve alignment. Green 3,552,557 discloses an arrangement wherein the spreader frame is shiftable rotatably and horizontally in directions both parallel and perpendicular to the fork tines. In the Green arrangement, the base frame itself is shiftable rotatably relative to the fork tines and this requires extremely wide tine receiving beams on the spreader frame in order to provide sufficient clearance for the necessary rotational movement. The Green arrangement also requires modification of the fork tines by drilling holes therethrough for connecting hydraulic cylinders which move the frame rotatably and longitudinally of the tines. In the paragraphs beginning at lines 30, 40 and 47 of column 5, Green broadly suggests alternative arrangements which involve no more than speculation because it is not clear how the suggested alternatives would be arranged to operate. Rumell 3,688,933 discloses an arrangement wherein the spreader frame is movable in all directions relative to the fork tines but there is no power means for so moving the spreader frame. Kinross 3,709,392 is of interest for another arrangement similar to that disclosed by Green. Tredray 3,713,556 discloses a spreader frame mountable upon fork tines and having extensible side frame members for positioning the container engaging devices at the corners of different size rectangles for using the spreader with different size containers.

SUMMARY OF THE INVENTION

A spreader for lifting containers and being mountable on generally horizontal fork tines includes base and upper frames. The base frame is mounted on the tines for movement relative thereto in a direction generally parallel to the longitudinal tine axes. Power means connected between the tines and base frame is selectively operable for so moving the base frame. A generally rectangular upper frame having container engaging devices at the corners thereof is movably mounted on the base frame for movement rotatably about a generally vertical axis and horizontally in a transverse direction generally perpendicular to the tine axes. Selectively operable common fluid power means is connected between the base and upper frames for either selectively rotating the upper frame or moving same transversely.

In one arrangement, the common fluid power means for moving the upper frame rotatably and transversely comprises a pair of hydraulic cylinders having cylinder axes extending generally perpendicular to the tine axes and spaced-apart in a direction parallel to the tines axes.

In accordance with a preferred arrangement, at least one of the base or upper frames has an elongated slot therein receiving an outwardly extending pin on the other frame for restraining the upper frame against complete displacement from the base frame, and for guiding rotational and transverse movement of the upper frame relative to the base frame.

The fork tines have vertical rear portions and a brace spanning such vertical portions is bolted thereto. A single hydraulic cylinder substantially centrally located between the fork tines is connected to the brace and to the base frame for moving the base frame longitudinally of the tines.

It is a principal object of the present invention to provide an improved spreader frame for use with a fork truck or the like.

Another object of the invention is to provide such a spreader frame which is capable of movement rotatably, and horizontally in two different directions relative to the fork tines for properly aligning the spreader frame with a container without requiring extensive manipulation of the vehicle.

A further object of the invention is to provide such a spreader frame having an improved guiding and retaining arrangement for guiding the upper frame during movement relative to the lower frame and for preventing complete displacement of such upper frame relative to the base frame.

BRIEF DESCRIPTION OF THE DRAWING

The invention may take form in certain parts and arrangements of parts, a preferred embodiment of which will be described in detail in this specification and illustrated in the accompanying drawing which forms a part hereof.

DESCRIPTION OF A PREFERRED EMBODIMENT

Figure 1:
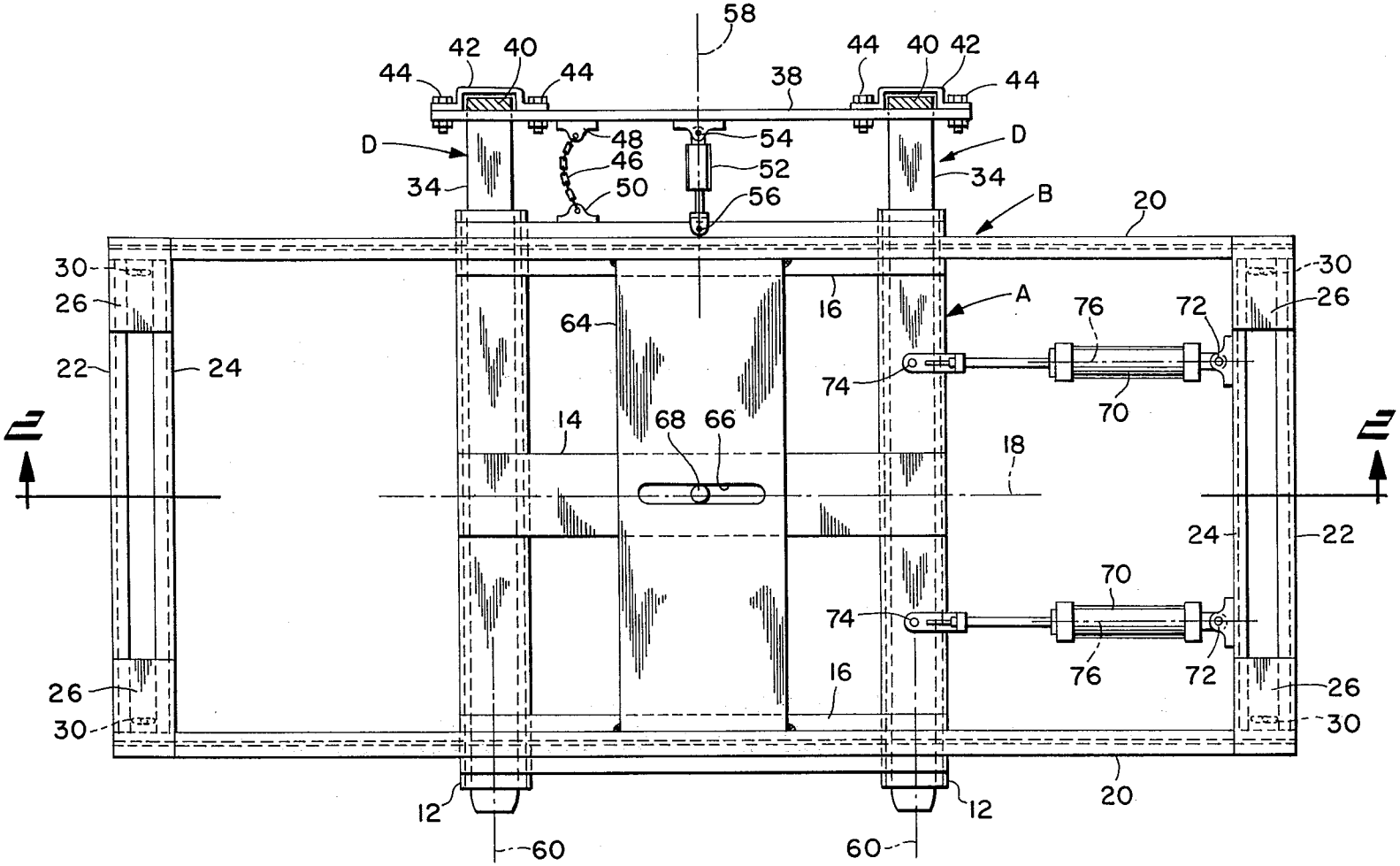
FIG. 1 is a plan view of a spreader frame constructed in accordance with the present invention.

Referring now to the drawing, wherein the showings are for purposes of illustrating a preferred embodiment of the invention only and not for purposes of limiting same, FIG. 1 shows a spreader frame which includes a base frame A and an upper frame B movably mounted thereon.

It will be recognized that frames A and B are made up of structural beams suitably welded, bolted or riveted together. Base frame A includes a pair of spaced-apart parallel box beams 12 having generally rectangular cross-sectional configurations. A central plate 14 and opposite end plates 16 are welded across the top of box beam 12 to form the base frame. It will be recognized that many other bracing arrangements may be used to form such base frame.

Upper frame B is generally rectangular and has a longitudinal axis 18 which generally coincides with the midpoint of base frame A between the opposite ends of box beams 12. Upper frame B has spaced-apart parallel opposite side beams 20 and spaced-apart parallel opposite end beams 22.

Upper frame B includes additional structural members 24 spaced inwardly from end beams 22 for supporting container engaging devices defined by twist-lock housings 26 adjacent the four corners of upper frame B.

Figure 2:
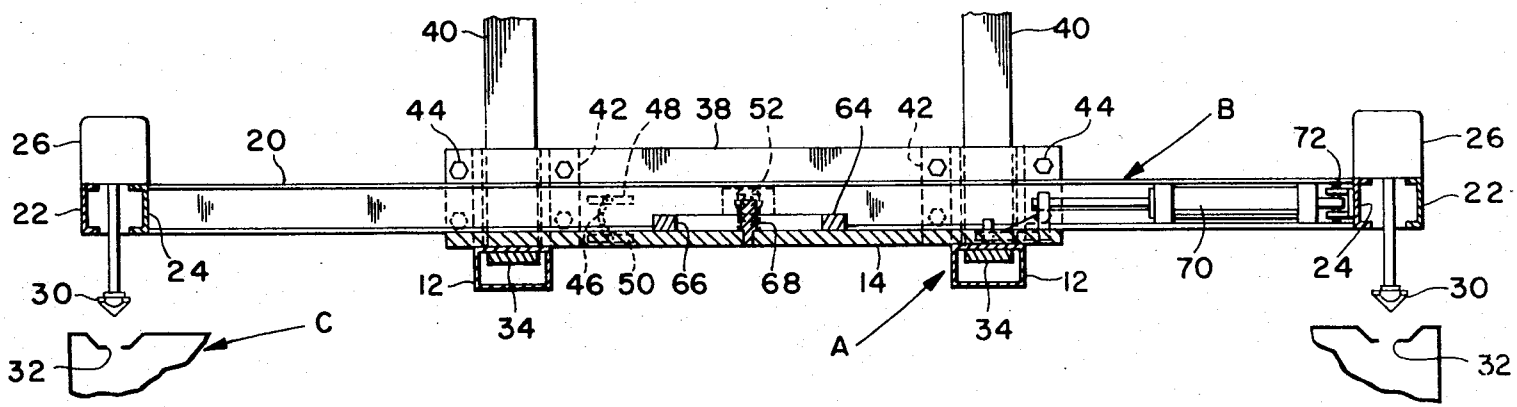
FIG. 2 is a cross-sectional elevational view looking generally in the direction of arrows 2—2 of FIG. 1.

Each twist-lock housing 26 includes a depending generally T-shaped container engaging member 30 which is receivable in an elongated opening generally shown at 32 in FIG. 2 at the top four corner portions of a container C. Twist-lock housings 26 are of a well-known type and once T-shaped devices 30 are received in openings 32, operation of hydraulic cylinders rotates such T-shaped devices 90° for locking the enlarged end portions of devices 30 within openings 32.

Tines D on a fork truck or the like include parallel spaced-apart generally horizontal tine portions 34 receivable through box beams 12. Box beams 12 are preferably of somewhat greater width than horizontal portions 34 in order to facilitate insertion of such horizontal portions through beams 12 and to allow slight lateral movement of base frame A relative to such horizontal portions. Box beams 12 have a substantially greater depth than the thickness of horizontal tine portions 34 in order to allow slight tilting movement of base frame A relative to such horizontal portions. Thus, when the vehicle is on even terran and frame B does not extend parallel to the top of a container, slight vertical floating movement between frame B and horizontal tine portions 34 will allow the frame to come into substantial parallelism with the top of the container so that T-shaped devices 30 will be properly received through the top openings in the container.

An elongated structural brace in the form of a plate 38 spans vertical portions 40 of tines D and is secured thereto by brackets 42, and nut and bolt assemblies 44. A safety chain or the like 46 is connected to suitable brackets 48 and 50 on brace 38 and rear end plate 16 for preventing complete displacement of base frame A from horizontal tine portions 34.

A double-acting hydraulic cylinder 52 is pivotally connected to brace 38 as at 54 and to rear end plate 16 as at 56. Longitudinal axis 58 of cylinder 52 is located substantially centrally between longitudinal tine axes 60 which also represent the longitudinal axes of box beam 12 in FIG. 1. Selective extension and retraction of cylinder 52 will selectively shift base frame A longitudinally of horizontal tine portions 34 parallel to axes 60. Suitable sintered metal bearing pads or rollers may be located between box beam 12 and horizontal tine portions 34 to facilitate such movement by selective operation of cylinder 52. Such movement of base frame A relative to horizontal tine portions 34 carries upper frame B along with it.

Upper frame B has a central plate 64 extending across side beams 20 and includes a central elongated slot 66 in general alignment with upper frame longitudinal axis 18. Central plate 14 on base frame A has a centrally located pin 68 welded or otherwise suitably secured thereto and extending upwardly therefrom for reception in elongated slot 66.

A pair of double-acting hydraulic cylinders 70 are pivotally connected to beam 20 of upper frame B as at 72 and to the upper surface of one box beam 12 as at 74. Each cylinder 70 has a longitudinal cylinder axis 76 extending generally parallel to upper frame longitudinal axis 18 and equidistantly spaced on opposite sides thereof. Suitable bearing pads of sintered metal or the like may be provided between upper frame B and base frame A to facilitate movement of upper frame B relative to lower frame A. Selective energization of cylinders 70 in common directions will shift upper frame B in a generally horizontal direction parallel to its longitudinal axis 18 and generally perpendicular to tine axes 60. Selective energization of cylinders 70 in opposite directions will cause upper frame B to rotate about a generally vertical axis corresponding to the longitudinal axis of pin 68.

Cylinders 70 together define a common power means which is selectively operable for either shifting upper frame B horizontally parallel to its longitudinal axis 18 or rotatably about pin 68.

It will be recognized that slot 66 can be located in base frame A if so desired, with pin 68 depending from upper frame B. In addition, it is possible to have such elongated slots in both frames, with one extending perpendicular to the other and having a pin trapped therebetween so that longitudinal shifting cylinder 52 could be connected with upper frame B for also shifting upper frame B longitudinally of fork tines 34 relative to base frame A. The pin and slot arrangement accurately guides upper frame B during its horizontal transverse movement relative to base frame A and also defines a pivot point about which rotational movement takes place for accurately guiding movement of frame B and bringing same back to its normal position shown in FIG. 1.

In addition to guiding movement of upper frame B, the pin and elongated slot arrangement also defines a retaining means for retaining upper frame B against complete displacement from base frame A.

The spreader frame has been shown in a generally schematic arrangement, and it will be recognized that additional bracing beams are commonly provided on such frames, including a truss-like framework above upper frame B for reinforcing same.

Outwardly flaring guide members may be provided on the outer periphery of upper frame B adjacent the corners thereof for engaging the outer top periphery of a container for guiding frame B into proper alignment therewith. All of cylinders 52 and 70 may be placed in a floating condition once frame B has been substantially aligned with the container and such guide members will then cam the frame into proper alignment in a known manner.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A spreader for lifting containers and being mountable on generally horizontal fork tines having longitudinal tine axes, said spreader comprising; a base frame mounted on said tines for movement relative to said tines generally parallel to said tine axes, base frame fluid power means connected between said tines and base frame for moving said base frame relative to said tines, a generally rectangular upper frame having container engaging devices at the corners thereof and being movably mounted on said base frame for rotational movement about a generally vertical axis and for transverse movement in a transverse direction generally perpendicular to said tine axes, and selectively operable common fluid power means connected between said base and upper frames for selectively rotating said upper frame relative to said base frame and moving said upper frame in said transverse direction relative to said base frame.

2. The spreader of claim 1 wherein said common fluid power means comprises a pair of hydraulic cylinders having cylinder axes extending generally perpendicular to said tine axes and spaced-apart in a direction parallel to said tine axes.

3. The spreader of claim 2 wherein said upper frame has a longitudinal axis and said cylinder axes are equidistantly spaced on opposite sides of said longitudinal axis.

4. The spreader of claim 3 wherein said upper frame has an elongated slot substantially coincidental with said longitudinal axis between said tine axes, and a centrally located fixed pin upstanding from said base frame and being received in said slot.

5. The spreader of claim 1 wherein said upper frame has a longitudinal axis extending perpendicular to said tine axes, an elongated slot in said upper frame between said tine axes substantially coincidental with said longitudinal axis, and a substantially centrally located fixed pin upstanding from said base frame and being received in said slot.

6. The spreader of claim 1 wherein said tines have vertical rear portions, a brace spanning said vertical portions and being bolted thereto, said base frame fluid power means comprising a single hydraulic cylinder connected between said brace and base frame and having a cylinder axis extending parallel to said tine axes and substantially centrally located between said tine axes.

7. The spreader of claim 1 wherein said upper frame has a longitudinal axis extending substantially perpendicular to said tine axes, one of said frames having an elongated slot therein between said tine axes and substantially aligned with said longitudinal axis, and a fixed pin extending from the other frame and being received in said slot.

8. A spreader for lifting containers comprising; a base frame having fork tine receiving means for mounting said base frame on tines of a fork truck or the like, said tine receiving means having longitudinal tine axes, a generally rectangular upper frame movably mounted on said base frame for limited transverse movement relative thereto in a direction extending generally perpendicular to said tine axes and for limited generally rotational movement about a vertical axis, selectively operable common power means connected between said base and upper frames for selectively moving said upper frame transversely or rotatably relative to said base frame, and cooperating restraining means between said base and upper frames for preventing complete displacement of said upper frame from said base frame while providing for said limited transverse and rotational movements.

9. The spreader of claim 8 wherein said upper frame has a longitudinal upper frame axis extending generally perpendicular to said tine axes, said restraining means comprising an elongated slot in one of said frames substantially aligned with said longitudinal upper frame axis and a fixed pin extending from the other frame and being received in said slot.

10. The spreader of claim 9 wherein said common fluid power means comprises a pair of hydraulic cylinders having cylinder axes extending substantially parallel to said longitudinal upper frame axis and located substantially equidistantly on opposite sides thereof.

11. In a generally rectangular container lifting spreader frame mountable upon tines of a fork truck or the like and including power means for shifting said frame relative to the tines rotatably about a generally vertical axis and generally horizontally in directions both parallel and perpendicular to the longitudinal axes of the tines, said spreader frame including base and upper frames, the improvement comprising; at least one elongated slot in one of said frames extending generally parallel to one of said horizontal directions, and a fixed pin extending from the other of said frames and being received in said slot.

12. The spreader of claim 11 wherein said elongated slot extends generally perpendicular to the longitudinal axes of the tines.

13. The spreader of claim 12 wherein said frame moves rotatably and in a horizontal direction generally perpendicular to the tine axes by movement of said upper frame relative to said base frame.

* * * * *